US007976115B2

(12) United States Patent
Gibson et al.

(10) Patent No.: US 7,976,115 B2
(45) Date of Patent: Jul. 12, 2011

(54) PRINTHEAD NUCLEATION DETECTION USING THERMAL RESPONSE

(75) Inventors: Bruce David Gibson, Lexington, KY (US); Shirish Padmakar Mulay, Lexington, KY (US); Nicholas Jon Post, Lexington, KY (US); Ramkumar Singh Sankar Singh, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 111 days.

(21) Appl. No.: 12/346,922

(22) Filed: Dec. 31, 2008

(65) Prior Publication Data

US 2010/0165029 A1 Jul. 1, 2010

(51) Int. Cl.
*B41J 2/01* (2006.01)

(52) U.S. Cl. ..... 347/10; 347/11

(58) Field of Classification Search ..... 347/5, 9, 347/10, 11, 14, 17

See application file for complete search history.

(56) References Cited

U.S. PATENT DOCUMENTS 5,418,558 A * 5/1995 Hock et al. ..... 347/14
5,428,376 A * 6/1995 Wade et al. ..... 347/14
6,820,958 B2 * 11/2004 Miyakoshi ..... 347/17

* cited by examiner

*Primary Examiner* — Huan H Tran

(57) ABSTRACT

A method for determining the pulse width for driving printhead nozzles in a thermal inkjet printer. The printhead is preheated to a desired temperature during a maintenance mode. The printhead nozzle heaters are successively driven in respective heating intervals, where each successive heating interval is characterized by shorter drive pulse width pulses occurring at a higher pulse frequency. The printhead temperature data received during each heating interval is processed to determine a respective temperature slope. The temperature slopes are compared to a desired threshold temperature slope, and when a match is found, the pulse width associated with the matched temperature slope is used to drive the nozzle heaters during subsequent printer operations to print characters on a print medium.

18 Claims, 6 Drawing Sheets

PRINTHEAD NUCLEATION DETECTION USING THERMAL RESPONSE

BACKGROUND

1. Field of the Invention

The present invention relates in general to thermal inkjet printers, and more particularly to methods and apparatus for determining the appropriate electrical firing parameters for driving a printhead to reliably eject ink droplets 2. Description of the Related Art The following details a technique for in-printer tuning of the fire pulse width using thermal nucleation detection. For a given ink formulation and ejector design, it is desirable that a precise dosage of energy be delivered for proper ink bubble nucleation and droplet ejection. The amount of energy applied to the nozzle heater of a printhead is adjusted by modifying the pulse width that is applied during an ejection event. If the amount of thermal energy applied to the ink is too low, then the ink jet will be weak, leading to low droplet velocity and increased droplet misdirection. If the energy is too high, this will lead to higher temperature variation and flooding related print defects, as well as decreased heater life. The ability to tune the firing pulse width reduces variations in printer/printhead combinations which results from normal manufacturing variations. The tuning of a printhead in a printer leads to more consistent droplet formation and droplet mass, and less droplet misdirection over a population of different printheads used in the printer.

Printer manufacturers have provided the capability of in-printer fire pulse width tuning using a drop velocity measurement method. This method uses an optical alignment sensor to scan printed patterns and measure the drop velocity for a set of fire pulse widths. The measured velocities are then used to select an operating fire pulse width corresponding to a droplet velocity above the "knee" of a jetting curve.

Another method of tuning a printhead involves printing a continuous purge bar while reducing the fire pulse width. Then, the pattern is scanned with an optical sensor and the print density is evaluated to determine the operating fire pulse width.

The operating energy for driving the printhead of a thermal inkjet printer can be determined by other means. U.S. Pat. Nos. 5,418,558; 5,428,376 and 6,820,958 disclose other methods for determining the optimum drive signal for a operating a printhead.

From the foregoing, it can be seen that a need exists for a method of determining a printhead nucleation point that can be used to select an appropriate fire pulse width without the need for printing a sample and without the need for external sensors. Another need exists for a method of determining the nucleation point using thermal feedback from the thermal sense resistors of the printhead.

SUMMARY OF THE INVENTION

According to the principles and concepts of the invention, disclosed are methods of determining the nozzle firing pulse width in an inkjet printer. The desired firing pulse width is set based on the ink nucleation point of a given printhead. A series of intervals of energy-balanced input pulse trains are applied to the printhead heaters. The pulse energy is decremented each interval and the jetting frequency is adjusted to maintain a constant total power delivered to the nozzle heaters. The slope of the printhead temperature for each interval is used to determine the nucleation point. The use of a slope increases the sensitivity of the measurements.

According to a feature of the invention, the printer controller enters a maintenance mode to determine the proper nozzle firing pulse width either for each new printhead installed in the printer, or during routine printhead maintenance to assure the proper nozzle firing pulse widths are employed. The in-printer determination of the proper firing pulse can also be used to maintain good nozzle health. The printhead nozzle heaters are successively driven in respective heating intervals, where each successive heating interval is characterized by shorter drive pulse width pulses occurring at a higher pulse frequency. The printhead temperature data received during each heating interval is processed to determine a respective temperature slope. The temperature slopes are compared with a predetermined threshold temperature slope, and when the predetermined temperature slope is exceeded, the pulse width associated with that temperature slope is used to determine the pulse width used to drive the nozzle heaters during subsequent printer operations to print characters on a print medium.

BRIEF DESCRIPTION OF THE DRAWINGS

The above-mentioned and other features and advantages of this invention, and the manner of attaining them, will become more apparent, and the invention will be better understood by reference to the following description of embodiments of the invention taken in conjunction with the accompanying drawings, wherein.

DETAILED DESCRIPTION

Figure 1:
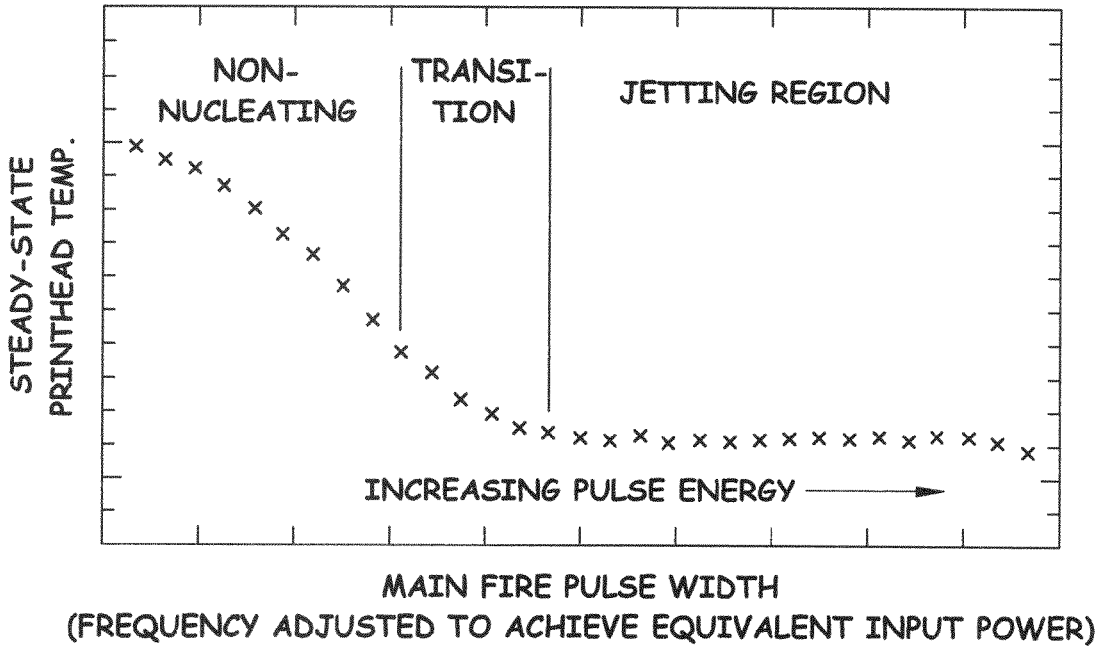
FIG. 1 graphically illustrates the steady-state temperature as a function of the main fire pulse width for a given power applied to a printhead.

The inkjet printers in which the features of the invention can be employed are of conventional construction. Typical inkjet printers include a programmed processor or controller for controlling the apparatus and equipment of the printer. The controller is electrically connected to the printhead to transmit address signals thereto for accessing particular nozzle heater to cause an ink droplet to be ejected from the associated nozzle. The printhead is driven laterally back and forth in a swath by a carriage mechanism, which is also controlled by the programmed controller. The carriage mechanism holds the print medium to scroll the same up and down to provide effective vertical movements of the print medium with respect to the printhead. Thus, by controlling the lateral movement of the printhead with respect to the print medium, and controlling the vertical movement of the print medium with respect to the printhead, and controlling the firing of the printhead nozzles, any character can be printed anywhere on the printable face of the print medium.

The printhead can be equipped with temperature sensors for sensing the temperature of various regions of the printhead. The temperature sensors can be thermal sense resistors for sensing the printhead temperature generated by the nozzle resistor heaters. Alternatively, the temperature sensors can be p-n junction devices calibrated to sense temperature by either resistive or capacitive means, or can be any other type of printhead substrate temperature sensor, The electrical signals corresponding to the printhead temperatures are carried from the printhead to an A/D converter for converting the temperature-related signals to corresponding digital signals. The printer controller is programmable to store many algorithms and routines to carry out all of the desired printing functions. In addition, the controller is programmable to carry out the techniques according to the invention in order to determine the optimum pulse width used to drive the printhead nozzle heaters to assure reliable operation for the particular printhead being employed.

A method determines the nozzle firing pulse width that corresponds to the nucleation point of a jetting curve that is representative of the particular printhead. A series of energy balanced, or constant power input pulse trains are defined. Each pulse train includes a plurality of heating intervals, with each interval having a number of cycles of given pulse widths, at a given frequency. A fire pulse may consist of a pulse train composed of an optional pre-fire pulse and a main fire pulse. The pulse train is applied at a frequency inversely proportional to the total pulse energy that is applied to the printhead heaters. Non-nucleating pulses may be applied to the printhead heaters to preheat the printhead to a desired temperature before the fire pulse train is applied. A constant number of nozzles of the printhead are then jetted from selected printhead regions to determine the jetting curve. The pulse energy of the main fire pulses remains constant during each heating interval of t ms, but the pulse width is decremented for each subsequent interval. The width of each main fire pulse is decremented at the end of each interval and the jetting frequency is adjusted upwardly to maintain a substantially constant total power applied to the printhead during each heating interval.

The range of pulse energies from the start of the multi-interval pulse train to the end of the pulse train is sufficient to ensure that the nucleation cutoff pulse energy is encountered. During the pulsing routine, the printhead temperature is measured using NSD thermal sense resistors, or other known substrate temperature measuring techniques. The temperature signals are sampled using an A/D converter at a suitable sampling frequency. The temperature of the printhead remains relatively constant during the process until jetting (nucleation) subsides, at which time the printhead temperature rapidly increases. After the printhead has been driven with all intervals of the main fire pulse train, the stored temperature data is post-processed to determine the particular interval where ink nucleation ceased.

The temperature data received from several thermal sense resistors is first averaged to reduce the amount of random noise sensed during the measurement. Next, the temperature slope of each interval is processed using a conventional n-point filter (for n samples per interval) which differentiates the data to obtain the slope for that interval. Then, the processed slope of each interval is compared to a predetermined threshold slope. The predetermined threshold slope is a slope of the printhead temperature change that is chosen to define where the jetting region transitions from jetting (nucleation) to non-jetting (non-nucleation). The first interval at which the slope exceeds the threshold slope indicates the nucleation point of the printer/printhead combination. The main nozzle fire pulse width corresponding to this nucleation point can then be used to set the operating fire pulse width during normal operation of the printer.

Since the input energy at each pulse width is maintained at a relatively constant level for each interval, there is no need to fire the printhead for extended periods of time waiting to achieve a new steady state temperature. This technique results in a relatively quick and accurate procedure, on the order of about five seconds, which is important for conserving ink and off-line printer time.

When a voltage pulse is applied to the printhead heaters, the electrical power is converted into thermal energy that is added to the printhead. The thermal energy is dissipated by a number of mechanisms, including conduction, convection, and ink droplet ejection. Conduction and convection are modes where heat from the semiconductor printhead chip escapes through materials in contact with the chip, including the chip itself, ink, diebonds the printhead body, and into the air. The heat developed within the printhead can also escape through the ejection of ink from the printhead nozzles. Each ink droplet ejected from the printhead also removes thermal energy from the printhead. Under constant energy input conditions, the printhead temperature will rise and reach a steady-state value as approximated by the following first order response.

$$T_{PH}(t)=T_0+(T_{ss}-T_0)(1-e^{-t/\tau}) \quad \text{(Eq. 1)}$$

The parameters of the equation are defined by: $T_{PH}$ is the printhead temperature, $T_0$ is the initial or starting printhead temperature, $T_{ss}$ is the steady-state printhead temperature, $\tau$ is a time constant describing the rate at which the temperature approaches steady state, and t is time.

The steady-state temperature of the printhead is a function of both the rate of energy input into the printhead system, and the mode and rate of heat dissipation. For jetting pulses, the steady-state printhead temperature will be lower due to the second mode of cooling, namely the jetting of ink.

The input energy (E) for a given pulse can be calculated from the supply voltage ($V_{heater}$), heater current ($i_{heater}$), and fire pulse width ($t_{pulsewidth}$). The mathematical relationship is shown The mathematical relationship is shown below.

$$E=(V_{heater})(i_{heater})(t_{pulsewidth}) \quad \text{(Eq. 2)}$$

For a given input energy, the total rate of input energy applied to a printhead (de/dt) can be determined for a specified jetting frequency (f) and number of nozzles (N) from the following equation, $$\frac{dE}{dt}=(E)(f)(N) \quad \text{(Eq. 3)}$$

By maintaining a constant rate of input energy to the printhead while varying the main fire pulse width, the steady-state temperature will be very consistent for jetting pulses. FIG. 1 graphically illustrates the steady state printhead temperature as a function of main fire pulse widths for a predetermined input power. The data was taken from a printhead installed in a test platform in which a set of nozzles (equally spaced from cyan, magenta and yellow vias) were jetted. FIG. 1 shows the regions identified by the non-nucleating region, the transition region and the jetting region. The non-nucleating region is a printhead operation region in which the temperature of the nozzle heater is insufficiently elevated to nucleate the ink into droplets. The jetting region is that region in which the temperature of the nozzle heater is sufficiently elevated to reliably nucleate the ink into droplets so that they are ejected outwardly from the nozzle. The transition region is that region in which the heat applied to the printhead causes the ink to begin nucleating. The transition region is characterized by a reduction in the printhead temperature as the thermal energy of the printhead is dissipated through drop ejection. The sets of main fire pulse widths and corresponding jetting frequency can experimentally determined to maintain the predetermined power input for each interval.

Figure 2:
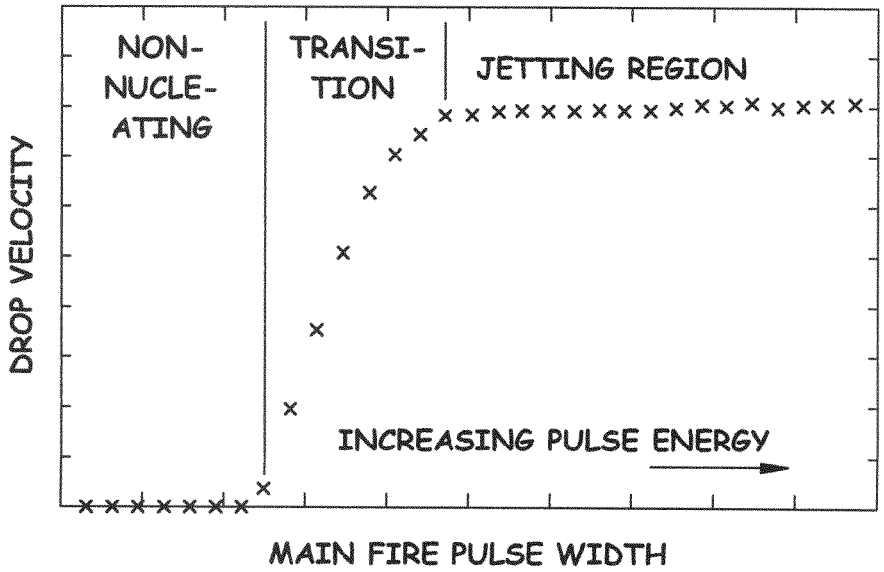
FIG. 2 graphically illustrates a jetting curve with ink drop velocity as a function of pulse energy.

The jetting conditions are experimentally determined to maintain a substantially constant power per interval. During the multi-interval main fire pulse train employed, the pulse widths become progressively shorter for each successive interval, while the frequency increases for each successive interval. With this arrangement, the energy or power input to the printhead remains relatively constant for each interval. It can be seen with the printhead of FIG. 1, that for main fire pulse widths above a given pulse width, the steady-state temperature of the printhead remains in a narrow temperature range for the respective heating intervals. The transition region represents the sloped region of the jetting velocity curve of FIG. 2. FIG. 2 illustrates the jetting curve and displays ink droplet velocity as a function of pulse energy. Here, for decreasing energies of the main fire pulse width, the velocity of the ink droplet begins to decrease, and the total mass of ink being jetted also decreases. The non-nucleating region is where the jetting of ink from a nozzle has completely ceased and the drive pulses are not long enough to induce nucleation.

The thermal nucleation detection algorithm according to one embodiment of the invention exploits the foregoing to quickly determine the pulse width at which the printhead temperature begins to increase, as shown in FIG. 1. According to the algorithm, a substantial number of nozzles of the printhead are operated or jetted a number of times during an interval, and for plural intervals. Each interval has a set duration of a fraction of a second, in the millisecond range. The nucleation cutoff pulse train begins with the longest pulse width. The duration of the interval is selected to allow sufficient temperature samples to be obtained per interval to establish a trend. In this manner, the temperature slope can be more accurately determined, and sufficient time is allowed for the printhead temperature to reach a new steady-state temperature.

In summary form, the proper pulse width determination is carried out in the following manner:

1. The carrier moves the printhead to a maintenance station.

2. The printhead is heated to a temperature above the expected jetting temperature.

3. A specified number of nozzles are jetted in equal time intervals using a starting main fire pulse width and a starting frequency.

4. The thermal sense resistors are sampled a number of times during each interval.

5. After each interval expires, the main fire pulse width is decremented and the jetting frequency is incremented.

6. After jetting has been completed using all main fire pulse widths in a schedule, the printhead carriage returns to a home position.

7. If thermal sense resistor data is recorded from multiple thermal sensor resistors, the temperature data can be averaged.

8. The temperature slope of each heating interval is calculated using an n-point (n is the number of samples per interval) differentiator filter.

9. The interval slopes are compared with a threshold slope which is based on the thermal response time constant and steady-state temperatures from FIG. 1.

10. The nucleation cutoff pulse width is determined with the first interval having a temperature slope greater than the threshold slope, meaning that nucleation has stopped.

11. The operating main fire pulse width is selected based on detected nucleation point.

Reference is now made to the flow charts of FIGS. 3A-5 which show the detailed functions carried out by the controller of the printer to determine the proper drive pulse width for the particular printhead being employed. It is noted that the pulse width/frequency parameters of the drive pulses change during the algorithm, but the magnitude of the voltage of the drive pulses remains essentially constant.

The detailed description of the pulse width determination method is set forth below. The start of the process is shown by numeral 10 where the printhead temperature sense functions are initiated. In block 12, the controller determines whether the ambient temperature around the printhead is greater than a threshold value or expected limit. If the determination in block 12 is affirmative, then processing proceeds to block 14 where a flag flag_amb is set to unity. From block 14, processing proceeds to C in FIG. 5. If the decision in block 12 is negative, processing proceeds to block 16. As shown in program flow block 16, the printhead is moved to the extreme left or right position where the printhead nozzles are directed to a spit cup. The printhead is heated to the starting temperature and held for a stabilization period by non-nucleating pulses applied to the heaters (block 18). In block 20, the controller sets the variable "i" to unity, which starts the jetting portion of the algorithm. The variable "i" identifies the particular interval being generated and processed. In the example illustrated in the following flow charts, the number of intervals is N. A pre-fire pulse and delay between the pre-fire and main fire are also set. This is shown in program flow block 22. The controller sets the main fire pulse width and the jetting frequency to the starting values. In FIG. 1, the starting pulse width would be to the right on the horizontal axis, and would be decreased for subsequent intervals. In block 24, the controller starts the jetting operation to find the optimum jetting pulse width, and continues for T seconds. A substantial number of nozzles are activated or jetted for the interval and at the main fire pulse width associated with the $i_{th}$ interval.

During the interval all thermal sense resistors associated with the nozzle vias being jetted are sampled for a time period (block 26). In decision block 28, the controller determines if a thermal sense resistor has sensed a temperature greater than a threshold value. In the event that a thermal sense resistor signals that the printhead is at a temperature greater than the threshold value, as indicated in decision block 28, then processing branches to block 30, where the jetting procedure is stopped. A flag, flag_hot, is set to unity, and processing proceeds to C in FIG. 5.

If the temperature of the printhead is within the expected limits, then processing branches from decision block 28 to decision block 32. In decision block 32, the controller determines whether the variable i is equal to N. In the event that the value of i is equal to N, the controller proceeds to block 34 where the jetting is stopped as the jetting portion of the test has been successfully completed. From block 34, processing continues at B in FIG. 4 where the temperature data received during each heating interval is processed. If the decision in block 32 is negative, then processing proceeds to block 36 where the main fire pulse width is decremented and the jetting frequency is incremented. In block 38 the value of i is increment by one, meaning that the next printhead heating interval will generated and processed. Processing is then directed back to block 24, and the next interval proceeds as described above.

Figure 5:
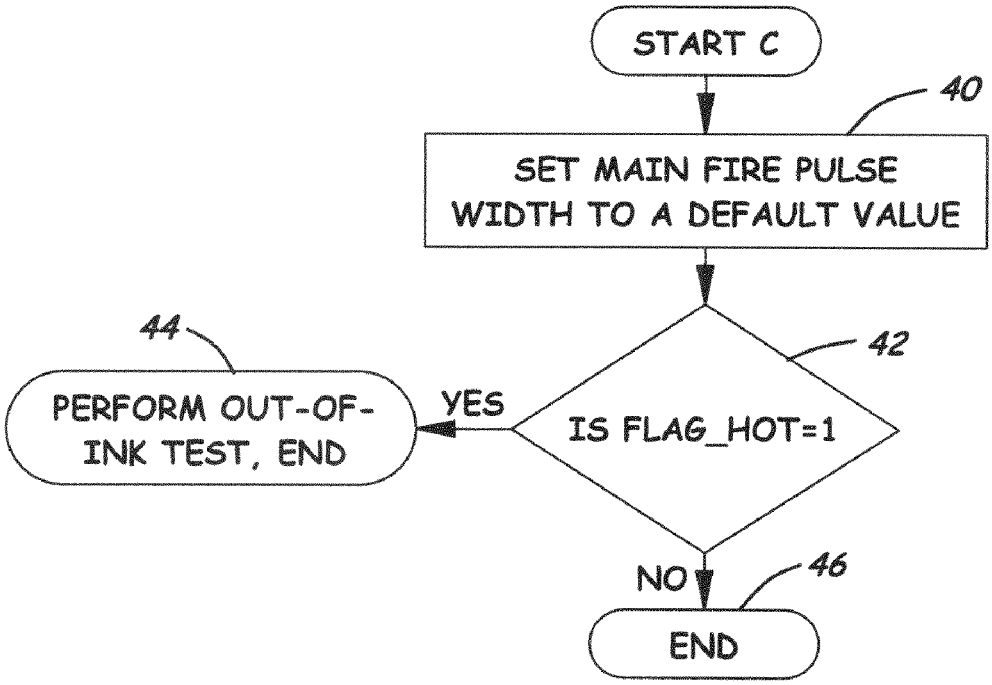
FIG. 5 is a flow chart that illustrates the detection of a printhead error condition.

The flow chart of FIG. 5 shows the processing for an error condition that could occur during the test to determine the optimum pulse width. During the pulse width determining procedure, if the printhead reaches a temperature that exceeds a safe operating temperature, then the procedure is stopped. In block 40, the main fire pulse is set to a default width. In decision block 42, the controller determines if the flag_hot indicator is set to unity. If it is, processing proceeds to block 44 where the controller performs an out-of-ink test. If the flag_hot indicator is not equal to unity in decision block 42, then processing proceeds to end the procedure at block 46.

Figure 3A:
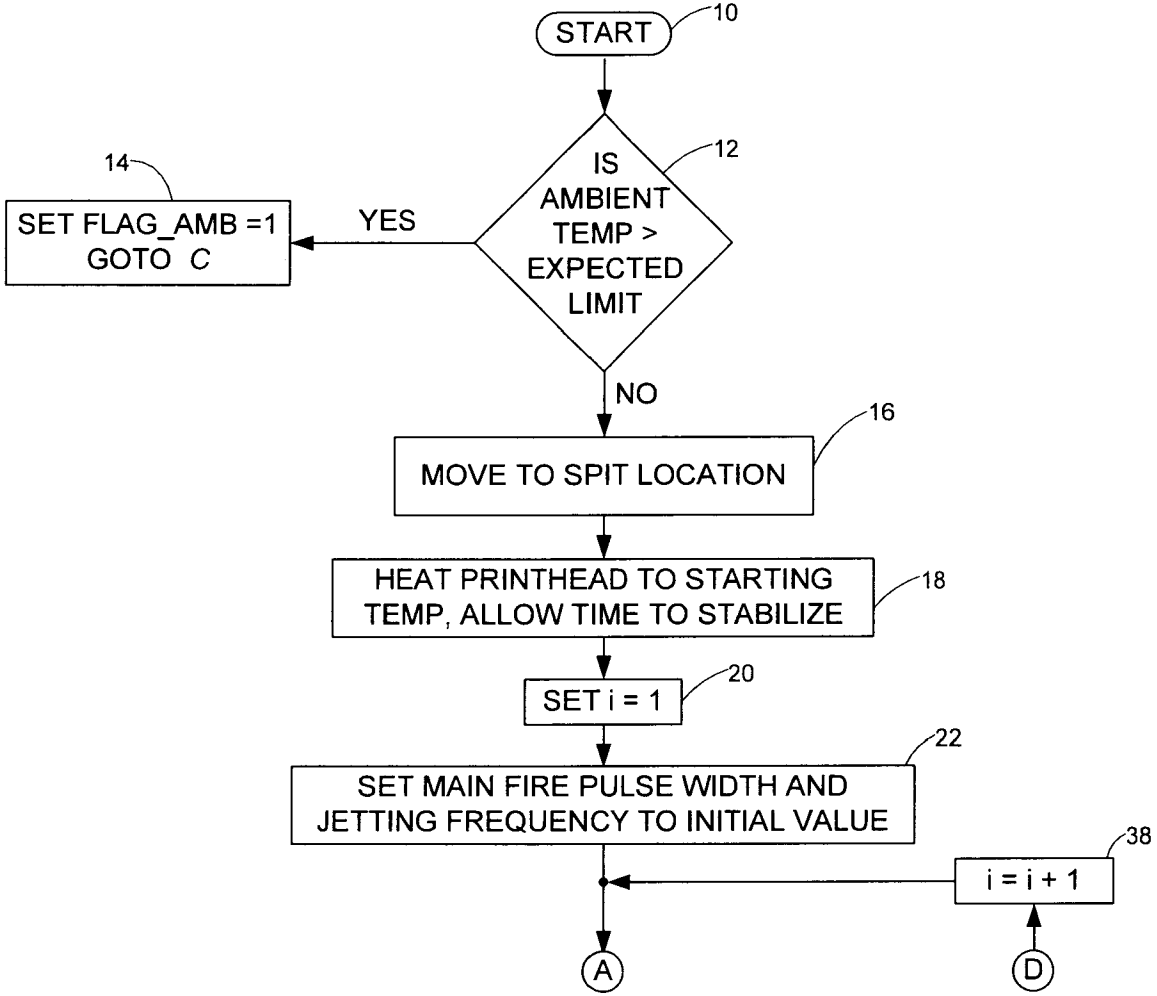
FIGS. 3A/3B are flow charts illustrating the temperature slope sensing process, and the corresponding ink jetting process.
Figure 3B:
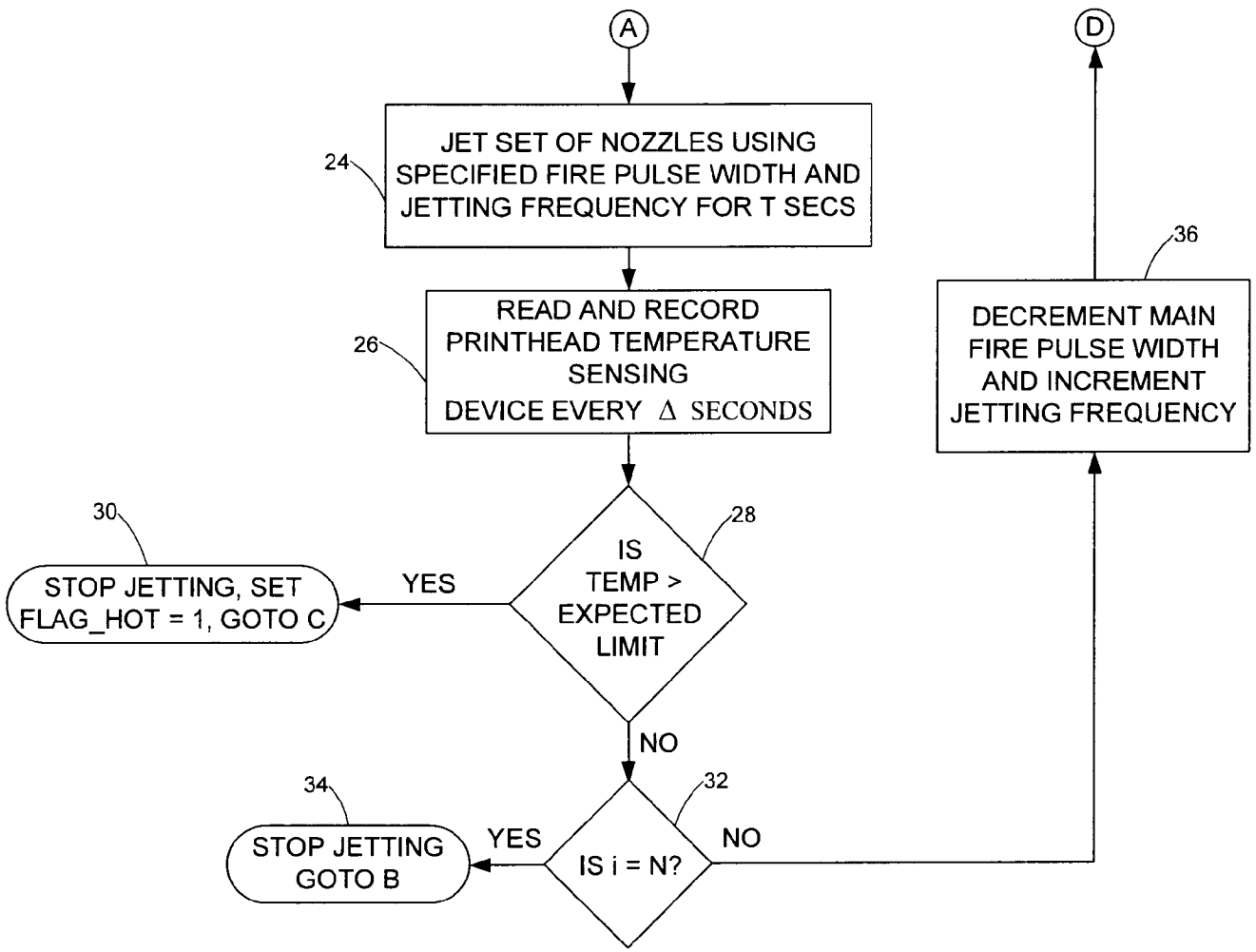
Figure 4:
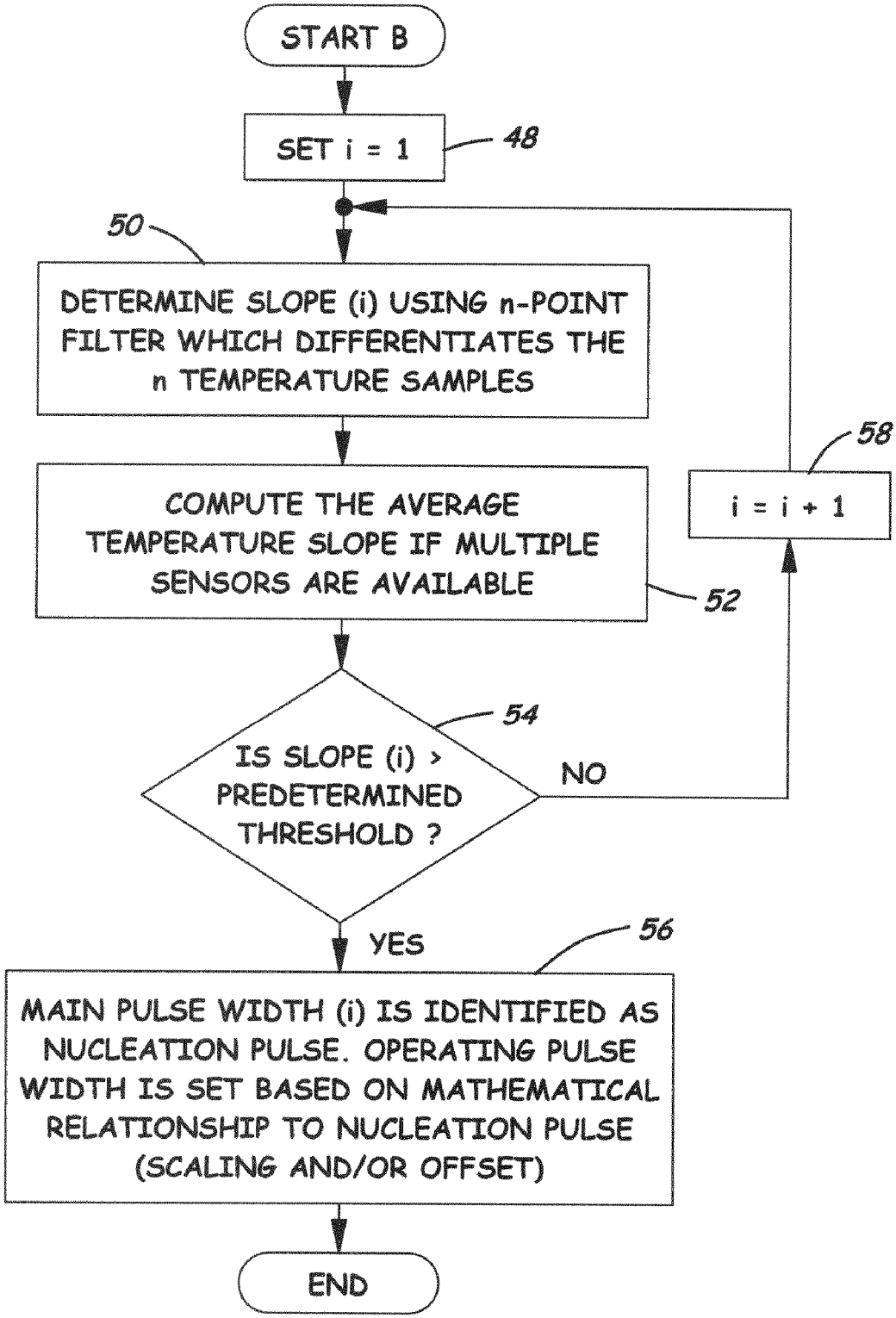
FIG. 4 is a flowchart illustrating the process in determining the nucleation cutoff pulse width and the setting operation of the fire pulse width.

With reference back to decision block 32 of FIG. 3B, if the value of i is equal to total number of executed intervals, then processing branches to block 34 where jetting is stopped, as the number of intervals in the main fire pulse train have been completed. The controller then proceeds to block 48 of FIG. 4 and carries out a process to determine the nucleation cutoff pulse width, and to set the operational fire pulse width which the printer will use during normal printing. In program flow block 50, the controller determines the slope of the temperature sensed by the thermal sensor resistor(s) during each interval (i). The slope effectively defines the temperature change, if any, that occurred during each heating interval. This is accomplished in the preferred embodiment using an n-point differential filter, which is well known in the art. The use of an n-point differential filter corresponds to the n samples taken during each interval. Those skilled in the art may find it advantageous to employ other methods to determine the temperature slope.

When using the n-point differential filter, n measurements are recorded for each jetting interval. The differential filter is constructed to estimate the slope of the n temperature measurements using the relationship set forth below.

In program flow block 52, the controller calculates the average slope of the temperature sensed by each of the thermal sensor resistors for each interval. The overall slope for interval (i) is calculated by mathematically determining the mean of the temperature slopes of respective printhead temperatures sensed by the different thermal sense resistors. With reference to decision block 54 and blocks 58, 50 and 52 of FIG. 4, the controller finds the first interval that has a slope greater than the predetermined threshold. Each slope (i) that was previously calculated in block 52 is then compared to the threshold slope, and when the first slope (i) is found that satisfies the predetermined criterion, then the operating printhead fire pulse width is set to the pulse width associated with the interval which satisfied the predetermined slope criterion, i.e., the threshold slope. In block 56, the controller sets the main operating pulse width based on the nucleation cutoff pulse determined in block 54. The processing of the function in block 56 completes the pulse width determination procedure that assures reliable nucleation for the particular printhead being employed in the printer. As can be seen, the procedure can be quickly carried out without the use of a paper sample, using excessive ink or other time consuming measures.

Figure 6:
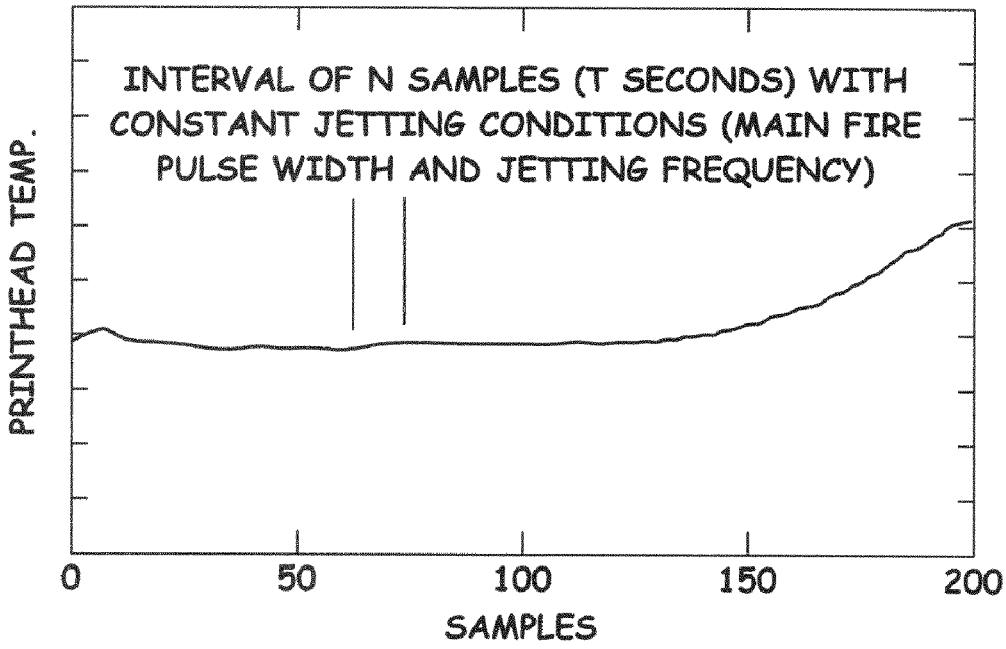
FIG. 6 graphically illustrates the printhead temperature over a number of intervals, where the printhead temperature is sampled n times for each interval.
Figure 7:
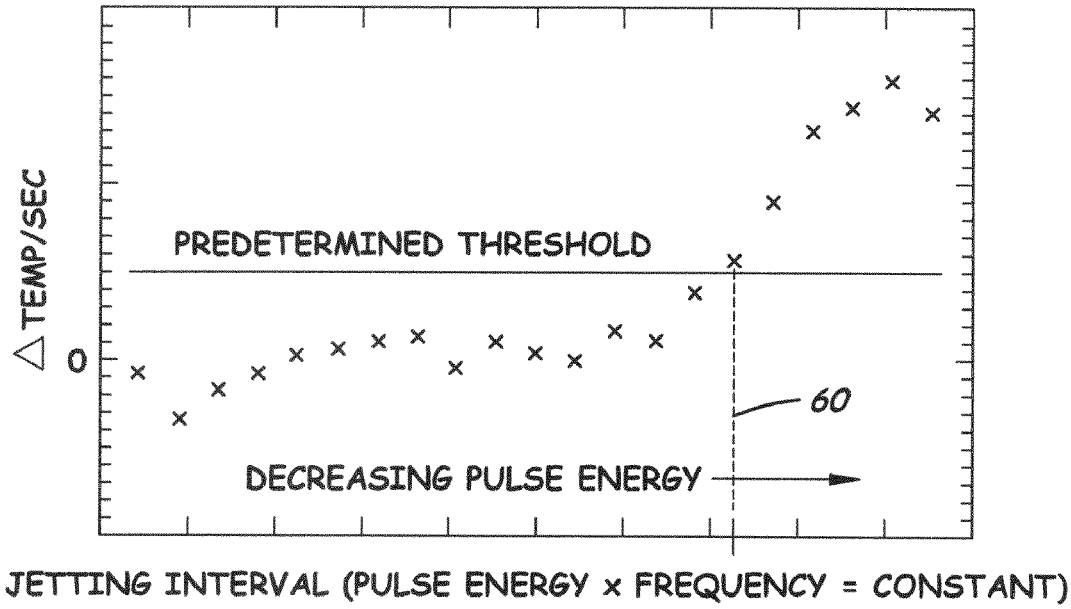
FIG. 7 graphically illustrates the change in printhead temperature as a function of the jetting interval, and the predetermined threshold slope.

Shown in FIGS. 6 and 7 are the results of the procedure applied in practice for obtaining the proper fire pulse width for driving a printhead in a thermal inkjet printer. FIG. 6 shows the thermal sensor resistor data averaged from three thermal sensor resistors. Each jetting interval is represented by n samples acquired in each set interval. The data is then used to calculate the temperature slope described above for each interval using the n-point differential filter.

FIG. 7 illustrates the calculated slope plotted against the main fire pulse width. It can be seen that the temperature slope is relatively flat for the first twelve intervals. Then the slope begins to increase and exceeds the threshold value at a main fire pulse width identified by broken line 60. The pulse width value (on the horizontal axis) associated with line 60 is then used to set the operating pulse width of the printhead that was subject to the test procedure.

The foregoing description of the several methods and an embodiment of the invention has been presented for purposes of illustration. It is not intended to be exhaustive or limit the invention to the precise steps and/or forms disclosed, and obviously many modifications and variations are possible in light of the above teaching. It is intended that the scope of the invention be defined by the claims appended hereto.

What is claimed is:

1. A method of controlling a printer of the type having a printhead with a plurality of nozzles, a heater associated with each nozzle, and where the heater is responsive to a pulse for heating ink and jetting the ink through the nozzle, and a thermal sensor for measuring printhead temperature, comprising:

heating the printhead to a predetermined temperature;

driving the nozzle heaters during a first interval with pulses having a starting pulse width and a starting frequency;

driving the nozzle heaters during subsequent intervals with respective pulses having decremented pulse widths and frequencies having incremented frequencies;

processing a temperature change of the printhead during each interval to determine a main fire pulse width that caused a predetermined temperature change; and using the main fire pulse width to drive the nozzle heaters to print characters on a print medium.

2. The method of claim 1 further including finding a temperature slope for each interval, and comparing the temperature slopes with a predetermined threshold temperature slope to determine the main fire pulse width.

3. The method of claim 2 further including finding a temperature slope between a jetting region and a transition region of the printhead.

4. The method of claim 2 further including finding a temperature slope at an ink nucleation cutoff state of the printhead.

5. The method of claim 1 further including driving the printhead heaters during each interval with pulse width and frequency intervals having a substantially constant power.

6. The method of claim 1 further including defining the pulse widths and the associated frequencies for each heating interval to produce a printhead temperature change in a region between a jetting region and a transition region of the printhead.

7. The method of claim 1 further including finding the main fire pulse width for each different printhead installed in the printer.

8. The method of claim 1 further including obtaining a plurality of printhead temperature samples during each interval to find a temperature slope of the printhead during the respective interval.

9. The method of claim 1 further including preheating the printhead to the predetermined temperature so that ink nucleation occurs in the printhead nozzles.

10. The method of claim 1 further including jetting the same number of nozzles during each interval.

11. A method of controlling a printer of the type having a printhead with a plurality of nozzles, a heater associated with each nozzle, and where the heater is responsive to a pulse for heating ink and jetting the ink through the nozzle, and a thermal sensor for measuring printhead temperature, comprising:

preheating the printhead to a predetermined temperature;

successively driving the heater with a heating interval, where each successive heating interval is characterized by shorter pulse width pulses at a higher pulse frequency;

processing printhead temperature data received during each heating interval to identify a desired criterion;

when the desired criterion is found, associating the desired criterion with a heating interval in which ink nucleation begins to cease and a main fire pulse width used in the heating interval in which ink nucleation began to cease; and driving the heater with the main fire pulse width during subsequent printer operations to print characters on a print medium.

12. The method of claim 11 further including obtaining a plurality of printhead temperature samples from the thermal sensor during each said heating interval.

13. The method of claim 11 further including obtaining a plurality of printhead temperature samples from a plurality of thermal sensors during each said heating interval.

14. The method of claim 13, further including finding a temperature slope of the printhead temperature of each of the thermal sensors, and finding a mean of the temperature slopes and storing the mean temperature slope for each heating interval.

15. The method of claim 14 further including receiving a printhead temperature from each of a thermal sensor associated with nozzles jetting a different color ink.

16. The method of claim 11 further including selecting the desired criterion as nucleation cutoff.

17. A printer of the type having a printhead with a plurality of nozzles, a heater associated with each nozzle, and where the heater is responsive to a pulse for heating ink and jetting the ink through the nozzle, and a thermal sensor for measuring printhead temperature, comprising:

a controller programmed to:

successively drive the heater during a heating interval where each successive heating interval is characterized by shorter pulse width pulses at a higher pulse frequency;

process printhead temperature data received during each heating interval to identify a desired criterion;

associate the desired criterion with a heating interval and a main fire pulse width used in the heating interval; and drive the heater with the main fire pulse width during subsequent printer operations to print characters on a print medium.

18. The printer of claim 17, wherein said desired criterion comprises a nucleation cutoff.

* * * * *